US005285555A

United States Patent [19]

Bell

[11] Patent Number: 5,285,555

[45] Date of Patent: Feb. 15, 1994

[54] ADJUSTER BUCKLE WITH LOCKING MEANS

[76] Inventor: Michael Bell, 1705 Triumphe Way, Warrington, Pa. 18976

[21] Appl. No.: 12,691

[22] Filed: Feb. 3, 1993

[51] Int. Cl.[5] ..... A44B 11/00

[52] U.S. Cl. ..... 24/196; 24/171; 24/194

[58] Field of Search ..... 24/196, 194, 171

[56] References Cited

U.S. PATENT DOCUMENTS

| | | | |
|---|---|---|---|
| 688,503 | 12/1901 | Cross | 24/196 |
| 2,754,560 | 7/1956 | Warner et al. | 24/196 |
| 3,169,291 | 2/1965 | Stacherl | 24/196 |
| 3,293,713 | 12/1966 | Gaylord | 24/196 |
| 3,407,451 | 10/1968 | Dewey et al. | 24/196 |
| 3,831,226 | 8/1974 | Nelson et al. | 24/196 |

*Primary Examiner*—Victor N. Sakran
*Attorney, Agent, or Firm*—Caesar, Rivise, Bernstein, Cohen & Pokotilow, Ltd.

[57] ABSTRACT

A buckle for a belt or harness comprising a ring member defining a hollow interior space, a slidable bar, and releasable securable lock. The ring member has a first and a second side section, and a first and a second end section, which are connected to one another. The slidable bar is mounted between the side sections and is movable between a position immediately adjacent the first end section and a position immediately adjacent the second end section. The first end section of the buckle is securable to one portion of a web of the belt or harness. A free end portion of a web of the belt or harness is arranged to extend through the ring's interior space between the first end section and the slidable bar, around the bar, and through the space between the bar and the second end section, from which it exits beyond the second end section of the buckle. Pulling on the free end of the web causes the slidable bar with the web section therearound to slide into close proximity with the second end section to fictionally hold the web in place. The lock is a spring biased member arranged to be normally biased in an extended orientation over the slidable bar to tightly engage it and the web portion wrapped therearound and thereby prevent the accidental release thereof. The lock is manually actuable to release the spring biased member, the slidable bar and the web section when desired.

6 Claims, 2 Drawing Sheets

ADJUSTER BUCKLE WITH LOCKING MEANS

BACKGROUND OF THE INVENTION

This invention relates to safety devices and more particularly to adjustable buckle for safety belts, harness, etc.

Various types of safety devices, e.g., safety harnesses, parachute harnesses, safety belts, etc., make use of adjustable buckles to enable the harness, belt, etc. to be adjusted to a desired position, e.g., into close conformity with the person wearing the safety device. Some buckles make use of a chape or catch to extend through a selected one of plural openings or holes in the web or strap to be secured by the buckle. Such buckles, are not continuously adjustable since they can only be adjusted to the discrete positions established by the opening or holes in the web or strap. Continuously adjustable buckles are, however, available. Such buckles commonly make use of a rectangular rim or frame having a pair of side sections and a pair of end sections. A slidable arm is mounted between the side sections and is arranged to be slid therealong so that the arm can be disposed close to either of the end sections. Such buckles are normally fixedly secured to one portion of a web or strap by looping a portion of the web or strap about a first one of the end sections and then sewing or riveting the loop together. The free end of the web or strap to which the buckle is fixedly secured (or the free end of another web or strap) is arranged to be connected to the buckle by extending it through the frame's interior space between the other end section and the slidable bar, around the bar, and through the space between the bar and that end section, from which it exits the buckle. By pulling on the free end of the web the slidable bar with the web section therearound is drawn into close proximity with the other end section so that it is fractionally held in place.

While prior art adjustable buckles are suitable for enabling the continuous adjustment of a webs or straps connected thereby, they never the less leave something to be desired from the standpoint of their propensity to loosen, particularly if tension is not maintained on the web or strap. For example, in applications, where such buckles are used on safety harnesses worn by workers under conditions where no tension is maintained on the strap or web, if the worker bends over the buckle's slide may slip, thereby releasing the web. This accidental web releasing action is shown in FIG. 2.

Fortunately, the free end of the web or strap used in a safety device incorporating such an adjustable buckle is folded over itself at least twice and then sewn or otherwise fixed in place. This results in a thick free end of the web or strap, which is resistent to accidental escape from the space in the buckle's frame. Accordingly, while the buckle may loosen, it is unlikely to completely disconnect the web or strap sections it serves to connect. In some applications this may be, at worst, an inconvenience. However, in other applications, e.g., where the buckle is on a safety harness, the fact that the buckle can loosen may mean that a portion of the worker's body may slip out of the portion of the harness or safety belt with the loosened buckle. Obviously, such action may be intolerable.

OBJECTS OF THE INVENTION

Accordingly, it is a general object of this invention to provide a freely adjustable buckle for use on a safety harness or belt which overcomes the disadvantages of the prior art.

It is a further object of this invention to provide a buckle which can be readily adjusted, but which includes locking means to prevent its accidental release.

It is yet a further object of this invention to provide a readily adjustable and lockable buckle which is easy to use.

It is still a further object of this invention to provide a readily adjustable and lockable buckle which is simple in construction.

SUMMARY OF THE INVENTION

These and other objects of this invention are achieved by providing a buckle for use on a web of a belt or a harness. The buckle comprises a ring member defining a hollow interior space, a slidable bar, and releasable securable locking means. The ring member comprises a first and a second side section, and a first and a second end section. The sections are connected to one another, with the slidable bar being slidable mounted between the side sections and movable therealong between a position immediately adjacent the first end section and a position immediately adjacent the second end section. The first end section of the buckle is securable to a portion of the web of the belt or harness. The buckle is arranged to have another portion of that web of material or of another web forming the belt or harness extend through the hollow interior space in the ring member between the first end section and the slidable bar, to extend around the slidable bar, through the hollow interior space between the slidable bar and the second end section and then beyond the second end section. By pulling on the free end of the web the slidable bar with the web section therearound slides into close proximity with the second end section to hold the web in place. The locking means comprising a member arranged to be selectively extended over the slidable bar with the web section therearound to releasable secure the slidable bar and the web section, and thereby prevent the accidental release thereof.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
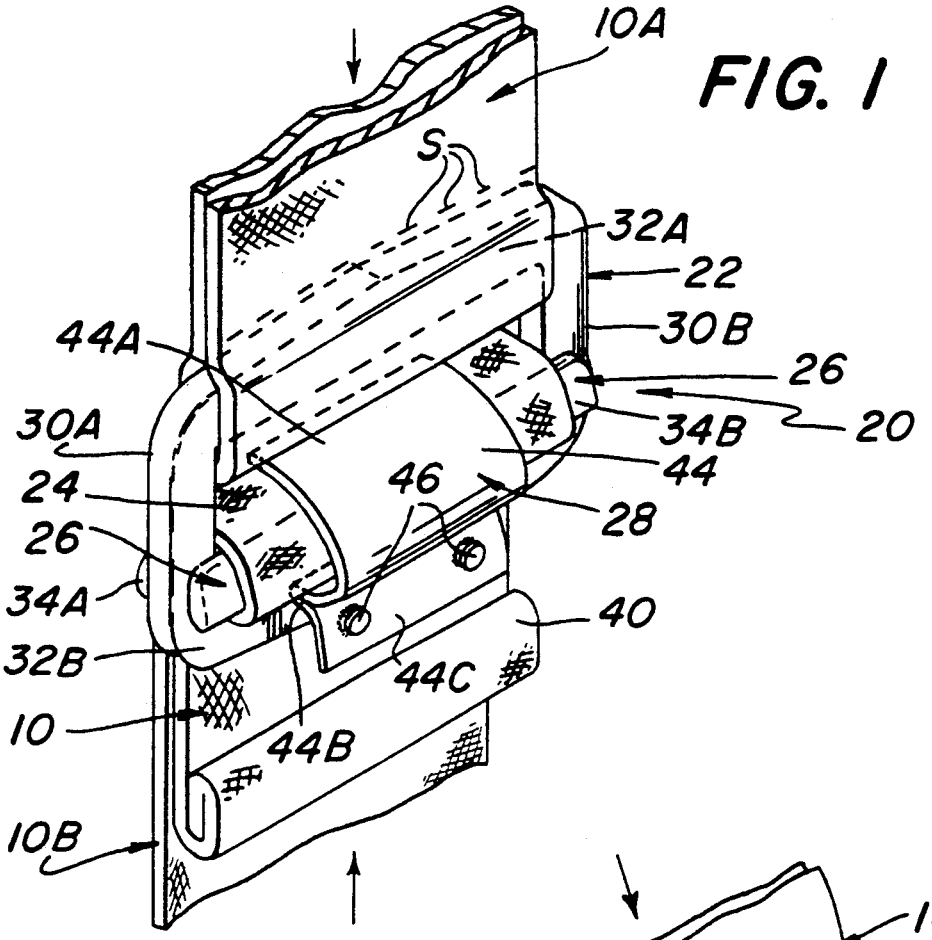
FIG. 1 is an orthogonal view of a first embodiment of an adjustable buckle with locking means constructed in accordance with this invention connecting two strips of a webbing, e.g., portions of a harness or safety belt, together, and wherein locking means is engaged to prevent inadvertent release of the buckle.
Figure 2:
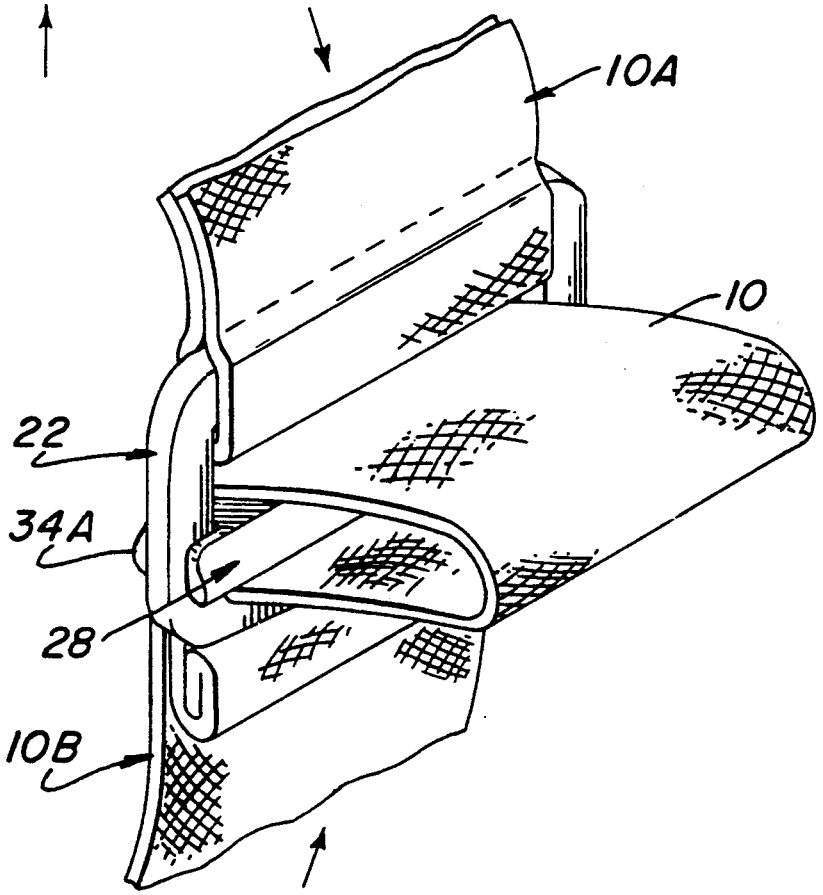
FIG. 2 PRIOR ART
FIG. 2 is an orthogonal view of similar to FIG. 1 but showing a prior art adjustable buckle connecting two such strips of webbing together, but which has become accidentally loose.

Referring now to various figures of the drawing where like reference numerals refer to like parts there is shown at 20 in FIG. 1, one embodiment of an adjustable buckle constructed in accordance with this invention. The buckle is arranged to secure two portions 10A and 10B of a web or strap 10 formed of a flexible material, e.g., a woven nylon harness strap, together. The portions 10A and 10B may be portions of the same web or strap, e.g., respective ends of a loop or band, or may comprise end portions of two different webs or straps.

It should be pointed out at this juncture that while the buckle 20 can be used in any application wherein two portions of a single strap or web-like member or two strap or web-like members are to be releasable secured together, with the length of one of the members being continuously adjustable, the buckle of this invention has particular utility in safety devices, e.g., harness, belts, etc., wherein tension on the straps/webs connected by the buckle may not be maintained at all times. In this regard the buckles of this invention make use of locking means to hold the straps in position notwithstanding the fact that they may not be maintained under tension.

As can be seen clearly in FIG. 1 the buckle 20 basically comprises a square or rectangular ring-like frame 22 defining a hollow interior space 24 (FIG. 3), a slidable bar 26, and a releasable securable locking mechanism 28. In accordance with a preferred embodiment of the invention the frame 22 is formed as an integral unit of a tough and strong material, e.g., aluminum, and basically comprises a first side section 30A, a second side section 30B disposed opposite the section 30A, a first end section 32A, and a second end section 32B disposed opposite the section 32A.

Figure 3:
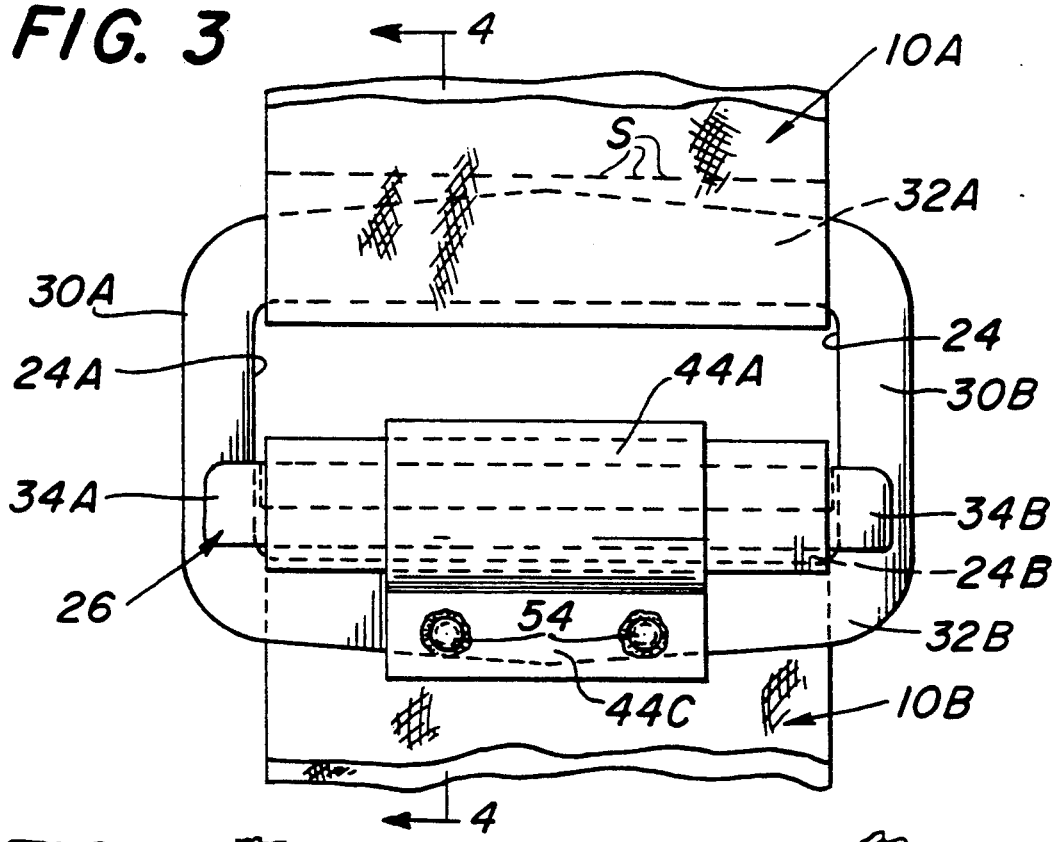
FIG. 3 is a slightly enlarged, front plan view of the adjustable buckle shown in FIG. 1.
Figure 4:
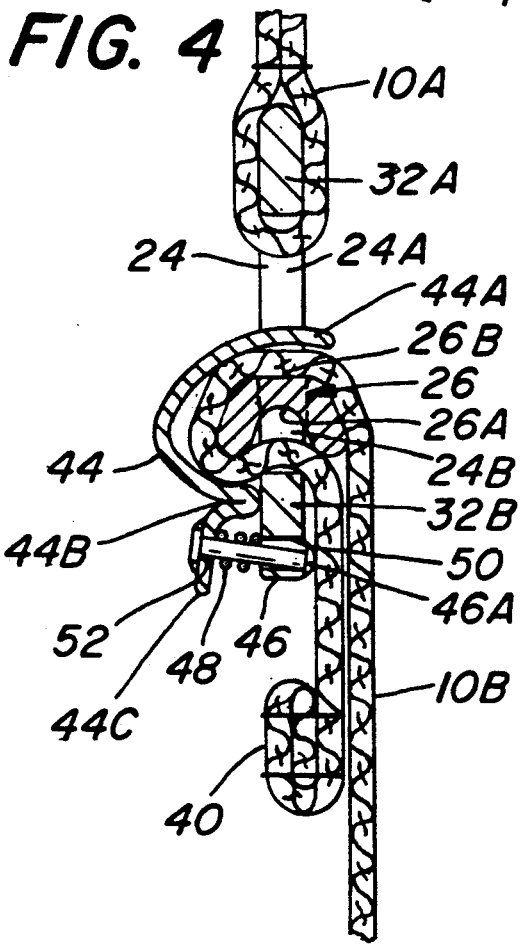
FIG. 4 is a sectional view taken along line 4—4 of FIG. 3.

The slidable bar 26 basically comprises an elongated member, of generally U-shape in cross section (see FIGS. 4 and 5), also formed of the same material as the frame 22. The underside of the slidable bar 26 includes a longitudinally extending channel 26A (FIGS. 4 and 5), whose function will be described later. The ends of the slidable bar 26 are in the form of a pair of yokes 34A and 34B, respectively. The bar 26 is mounted on the frame 22 so that its yoke 34A is located on the first side section 30A, while its other yoke 34B is located on the second side section 30B. In particular the side sections 30A and 30B are received within the yokes 34A and 34B, respectively, so that the bar can freely slide therealong between a position (called a "loosened" position) at which it is located immediately adjacent the first end section 32A, and a position (called a "locked" position) at which it is located immediately adjacent the second end section 32B as shown in FIGS. 1 and 3.

In accordance with the preferred embodiment of the invention shown herein the free end of strap/web portion 10A is fixedly secured to the buckle 20 by being looped around its end section 32A. The abutting portions of the portion 10 just outside the periphery of the buckle 20 are fixedly secured together by stitches. Alternatively, any suitable means, e.g., glue, rivets, etc., can be used to hold the first end section 32A of the buckle 20 within the loop of section 10A.

Figure 5:
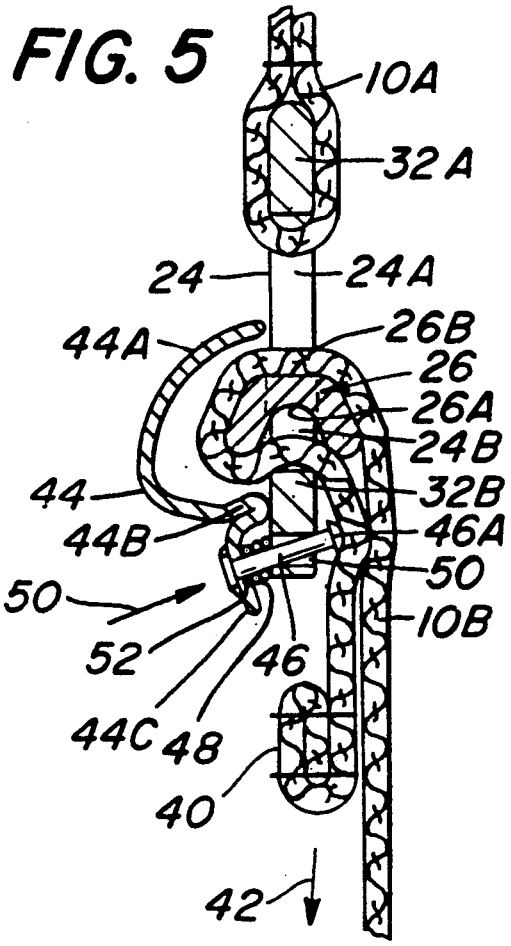
FIG. 5 is an enlarged, sectional view similar to that of FIG. 4, but showing the locking means of the adjustable buckle being manually released to enable the buckle to be adjusted.

In order to releasably secure the web portion 10B to the web section 10A via the buckle 20, the free end of the web portion 10B (which incidentally is folded over itself and sewn in place to create a triple thickness end 40) is threaded through portions of the buckle in the following manner, which is best seen in FIG. 5. In particular, the free end 40 is passed through the space 24A located between the upper end section 32A and the slidable bar 26, from which the web portion 10B is extended around the top surface 26B of the slidable bar 26, under the bar's, channel 26B, out through the space 24B located between the end section 32B and the bar 26, and out of the buckle 20 on the same face as it entered.

When the portion 10B has been threaded through the buckle as just described, and its free end 40 pulled downward in the direction shown by the arrow 42 in FIG. 5, the bar 26 is carried downward so that the web portion 10B is tightly confined between the channel 26A in the bar 26 and the end section 32B. Moreover the pulling on the free end 40 in the direction of the arrow 42 causes the length of the web portion 10B to be adjusted to the desired amount. So long as tension is maintained on the free end portion 40 of the web section 10B the buckle 20 is resistant to loosening. If however the tension should be released and the worker should bend over, and there could be a tendency of the slidable bar to slide toward the end section 32A, thereby releasing the frictional engagement on the web section 10B. However, the locking mechanism 28 of this invention prevents such an occurrence.

The locking mechanism 28 basically comprises an arm 44, a pair of mounting pins 46, and a pair of biasing springs 48 (FIGS. 5 and 3). The arm has an arcuate end portion 44A, an intermediate fulcrum 44B, an a manually depressible operating tab 44C, all formed as a integral unit of a strong material, e.g., aluminum. The arcuate end 44A is configured so that its undersurface is arranged to receive therein the slidable bar 26 with the web portion 10B wrapped thereabout. When the arm 44 is in its normal biased position, as will be described later with reference to FIG. 4, it overlies and tightly grasps the slidable bar with the web section 10B therearound to prevent any slippage therebetween.

The arm 44 is mounted on the buckle's end section 32B via the pins 46. To that end the end section 32B includes a pair of spaced apart holes 50. Each hole 50 is arranged to receive a respective one of the pins 46. Each pin is a rod-like member having an enlarged base 46A which engages one surface of the end section 32B when the pin extends through the associated hole 50. Each pin is arranged to extend through a respective hole 52 in the tab 44C to mount the arm on the pins. Thus, the top end of each pin includes an enlarged cap 54 preventing the tab 44C from sliding off of the pins. Each of the biasing springs 48 is a helical compression spring. One of the springs 48 is mounted on one of the pins 46 and is interposed between the end section 32B and the undersurface of the tab 44C. The springs thus provide a bias force on the underside of the tab to tend to move the tab 44C away from the buckle's end section 32B. The fulcrum 44B is of a sufficient length that when the springs 48 bias the tab 44C away from the buckle end section 32B, the fulcrum's end engages that buckle section 32B, whereupon the arm 44 is biased into the orientation shown in FIG. 4. As mentioned earlier in that orientation the arcuate portion 44A tightly engages the underlying web portion 10B and the slidable bar 26 located thereunder. This fictionally locks the web with respect to the buckle.

When it is desired to release the locking mechanism the tab 44C is depressed by a force directed in the direction of the arrow 56 of FIG. 5 downward against the bias of the springs whereupon the pins project further into the holes 50 and the fulcrum tilts so that the arcuate portion 44A tilts back and disengages from the web portion 10B as shown in therein. Accordingly, the buckle 20 can now be loosen or disconnected by the user as desired.

Without further elaboration the foregoing will so fully illustrate my invention that others may, by applying current or future knowledge, adapt the same for use under various conditions of service.

I claim:

1. A buckle for use on web of a belt or a harness, said buckle comprising a ring member defining a hollow interior space, a slidable bar, and releasable securable locking means, said ring member comprising a first and a second side section, and a first and a second end section, all of said sections being connected to one another, said slidable bar being slidably mounted between said side sections and movable between a position immediately adjacent said first end section and a position immediately adjacent said second end section, said first end section of said buckle being securable to a portion of said web, a free end portion of said web or another web of said belt or harness being extendable through the hollow space in said ring member between said first end section and said slidable bar, extending around said slidable bar, through the hollow interior space between the slidable bar and the second section and then beyond the second end section, whereupon pulling on said free end causes said slidable bar to slide into close proximity with said second end section to hold said free end portion of said web tightly within said buckle, said locking means being mounted on said second end section and comprising a concave member and a manually depressable portion, said concave member being arranged to be selectively extended over said slidable bar with the web section therearound to overlie and grasp and releasable secure said slidable bar and said web section in place, said concave member being normally biased to overlie and grasp said slidable bar with said web section therearound, said manually depressable portion of said locking means being depressible to cause said concave member to release said slidable bar with said web section therearound.

2. The buckle of claim 1 wherein manually depressible portion comprises a tab.

3. The buckle of claim 2 wherein said locking means additionally comprises a fulcrum interposed between said tab and said concave member.

4. The buckle of claim 3 additionally comprising a biasing spring interposed between said second end section and said tab.

5. The buckle of claim 4 wherein said locking means additionally comprises at least one pin extending through an associated opening is said second end section and through an associated opening in said tab, with said biasing spring interposed therebetween.

6. The buckle of claim 4 wherein said locking means additionally comprises a pair of pins, each of said pins extending through a respective opening in said second end section and through a respective opening in said tab, said pins being spaced from each other, and wherein said locking means additionally comprises respective biasing springs located on said pins and interposed between the associated tab portion and second end section.

* * * * *